US005325793A

United States Patent [19]

Martin

[11] Patent Number: 5,325,793

[45] Date of Patent: Jul. 5, 1994

[54] FOLDING TABLE

[75] Inventor: Donald A. Martin, Toorak, Australia

[73] Assignees: Teston Investement Pty. Lt., Toorak; Coralex Pty Ltd., South Yarra, both of Australia; a part interest

[21] Appl. No.: 949,536

[22] PCT Filed: Apr. 26, 1991

[86] PCT No.: PCT/AU91/00173

§ 371 Date: Nov. 6, 1992

§ 102(e) Date: Nov. 6, 1992

[87] PCT Pub. No.: WO91/16834

PCT Pub. Date: Nov. 14, 1991

[30] Foreign Application Priority Data

May 9, 1990 [AU] Australia ..... PK0013

[51] Int. Cl.[5] ..... A47B 3/00

[52] U.S. Cl. ..... 108/130; 108/115

[58] Field of Search ..... 108/115, 119, 125, 128, 108/129, 130

[56] References Cited

U.S. PATENT DOCUMENTS 1,862,911 6/1932 Snyder .

FOREIGN PATENT DOCUMENTS

| | | | |
|---|---|---|---|
| 3642328 | 8/1988 | Fed. Rep. of Germany | 108/119 |
| 553858 | 6/1923 | France . | |
| 0678419 | 12/1929 | France | 108/130 |
| 735181 | 11/1932 | France . | |
| 2367447 | 5/1987 | France . | |
| 129837 | 1/1929 | Switzerland . | |
| 160136 | 5/1933 | Switzerland . | |
| 626807 | 7/1949 | United Kingdom . | |

*Primary Examiner*—Jose V. Chen
*Assistant Examiner*—Gerald Anderson
*Attorney, Agent, or Firm*—Hovey, Williams, Timmons & Collins

[57] ABSTRACT

A two section folding table is disclosed which folds in the middle. A leg arrangement is hingedly attached to the underside of each section. The legs have two parts pivotally attached together with one end of a first part hingedly attached to the underside of the table and the first part folding flat against the underside of the table when the table is folded. A second part of the leg is pivotally attached to the first part and is folded against the top side of the table when the table is folded.

7 Claims, 2 Drawing Sheets

FIG 1
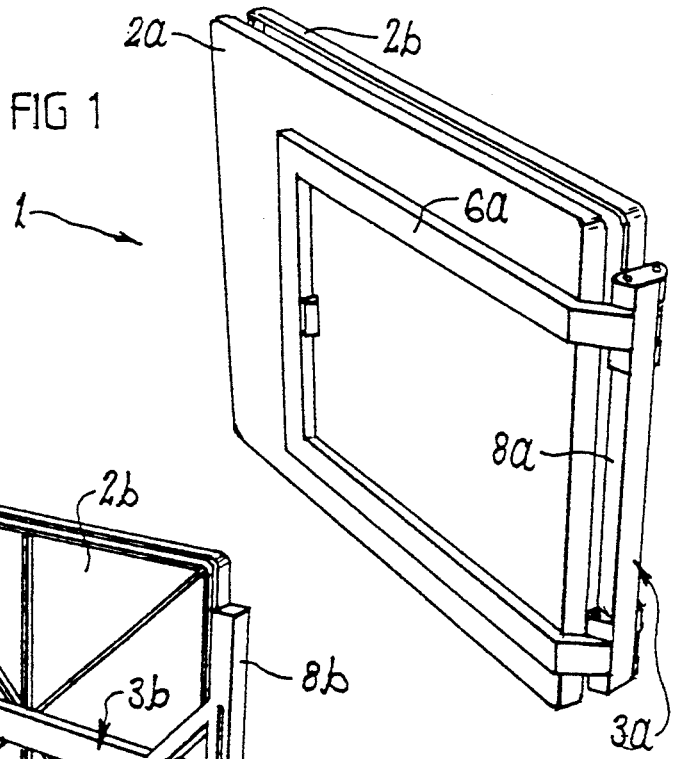
FIG 2
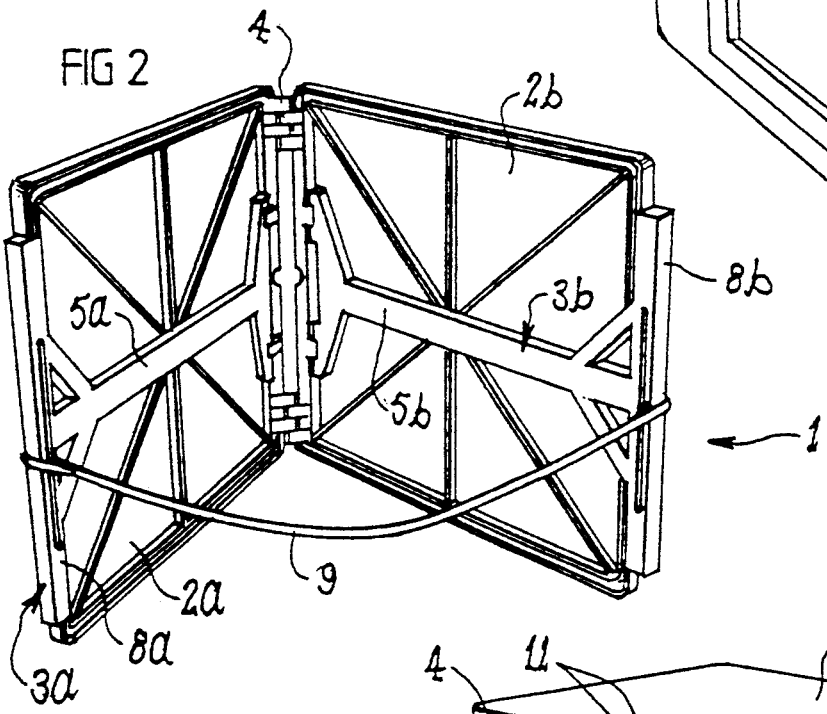
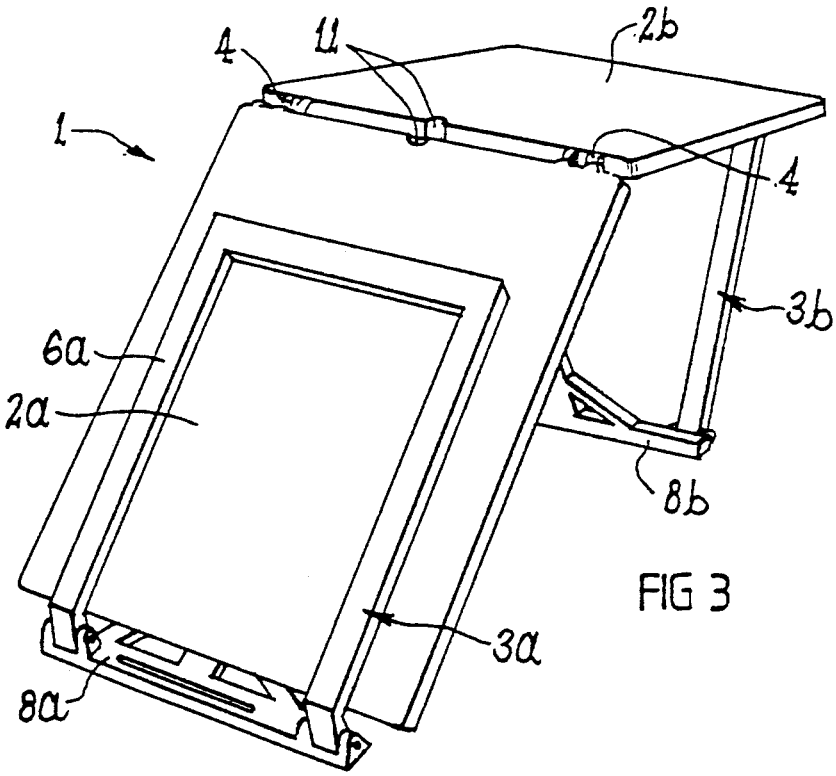
FIG 3

FOLDING TABLE

This invention relates to a folding table. It relates particularly to a folding table which folds in the middle in order to allow for easy storage and transportation.

Convenient and generally inexpensive portable tables which are suitable for a wide variety of applications, both indoors and outdoors, have been known for some time. Such tables typically include hinged legs which are foldable between an inactive position, in which they lie horizontally against the underside of the table surface, so that the whole table is substantially flat and allows for convenient storage, and a substantially vertical position in which they can function as table legs in the normal manner.

One well known table of this type is commonly referred to as a "card table". A card table has a substantially square surface and four independently hinged legs connected one at each corner of the underside of the table. Each leg is slightly shorter than the width of the table, allowing the legs to be conveniently accommodated against the underside of the table when the table is not in use.

Another type of commonly available folding table is a long table with a pair of legs attached by a hinge at each end. Australian Patent Application 27835/77 shows a table of this type. When the table is not in use, the legs are folded towards the centre of the table until they rest against the underside of the table. Various different methods have been employed for locking the legs into place in their active position, at right angles to the table surface, and in their inactive position, resting against the underside of the table surface.

Even after the legs have been folded into an inactive position, the shape of a table is frequently still too cumbersome to allow for convenient transportation and storage. One way of overcoming this problem is to divide the table top into two sections hinged together, so that the folded table has approximately half the length of the unfolded table.

Tables of this type are shown in Australian Patent Application 67399/74 and Australian Patent 512081. The table illustrated in FIG. 1 of Australian Patent 512081 has adjustable height folding legs and a hinge in the table-top which operates in such a manner that the two sections of the table top face outwards in opposite directions when the table is folded. However, the table disclosed appears to be suitable for light loads only. When the table is in use, the table legs are oriented at an angle of about 45° to the vertical and it is likely that this results in instability when a heavy load is applied to the table.

The table revealed in Australian Patent Application 67399/74 is a table tennis type table, divided into two sections which are hinged together about the net line. When the two sections are folded together about the hinge, the two table tops face each other and the leg arrangements fold down against the outside of the folded table. Each of the two table sections has a leg arrangement comprising a pair of legs hingedly attached to the underside of the table surface near the end furthest from the table top hinge, and a support brace hingedly attached to the underside of the table surface near the table top hinge. When the table is in its active position, the support brace is attached to the pair of legs to hold the pair of legs in position away from the underside of the table surface, and when the table is in its inactive position the support brace is disconnected from the pair of legs and the support brace and the pair of legs are both folded against the underside of the table. Once again, while a table of this sort is suitable for such applications as playing table tennis, it is not sufficiently strong to support a substantial load.

It is an object of the present invention to provide an alternative type of folding table.

According to the present invention there is provided a folding table comprising:

(a) a table top divided into two sections, each of which has an underside and a topside, the two sections being connected by a hinge arrangement; and (b) on the underside of each table top section a leg arrangement comprising:

(i) a leg brace having a top end and a bottom end, the top end being pivotally attached to the underside of the table top section near the hinge arrangement, and a leg member having a top end and a bottom end, the bottom end of the leg member being pivotally attached to the bottom end of the leg brace and the top end of the leg member being detachably attachable to the underside of the table top section at a location distant from the hinge arrangement, wherein, when the table is folded, the leg brace of each leg arrangement rests adjacent the underside of the table top section and the leg member rests adjacent the topside of the table top section.

The table-top sections may be of any suitable size and shape. It is preferred although not essential that the sections be substantially flat. It is furthermore preferred that the sections be substantially identical in shape, although again this is not necessary. It is preferred that the table-top sections be square or rectangular in shape, although numerous other shapes including semi-circles and triangles are also suitable.

The hinged connections between the various parts of the folding table may be arranged such that the folding table may fold down in any suitable manner. In one embodiment, the folding table may be made to fold such that the table top sections are arranged in a face-to-face manner. In an alternative embodiment, the table-top sections may be made to fold down into a back-to-back configuration. The leg braces will always be arranged so that they fold against the underside of their respective table-top sections, but the leg members may be arranged so that they either fold around against the top sides of their respective table-top sections or so that they fold together with the leg braces against the undersides of their respective table-top sections.

Although, in the simplest embodiment of the invention, each table-top section has only one leg arrangement, it is possible for each table-top section to have two or more leg arrangements.

The leg brace may be of any suitable shape and configuration. In an embodiment, it may comprise a single strut. In alternative embodiments, it may comprise two or more struts; a panel, a substantially rigid frame in triangular, X-shaped or any other suitable configuration; or any other suitable arrangement. The shape and configuration of the leg member may be selected from a similar list of suitable alternatives, although it is preferred that the top and bottom ends of the leg member be sufficiently broad to give the table an appropriate degree of stability. In the most preferred arrangement, the leg member comprises two struts arranged in similar position and orientation to conventional table legs, the two struts being connected at their bottom ends and at their top ends by substantially rigid braces.

It is further preferred that there be a limiting connection between the two leg arrangements. The purpose of the limiting connection is to limit the separation of the leg arrangements, and thus to add stability to the hinged connection between the table-top sections, especially when a heavy load is placed on the table near the middle. The limiting connection is preferably connected at or near the bottom of each leg arrangement. It may comprise any suitable limiting connection means including a strap, a chain, a rope, a wire, a cord or a strong thread.

The invention will now be described in more detail with reference to a preferred embodiment illustrated in the accompanying drawings. It is to be understood that the drawings and following description relate to a preferred embodiment only, and are not intended to limit the scope of the present invention.

FIG. 1 is a perspective view of the table in its closed position, suitable for storage.

FIG. 2 is a perspective view of the table of the present invention in a partly opened state.

FIG. 3 is a perspective view of the table of the present invention in a partly opened state with one leg arrangement in its operative position and the other leg arrangement in its inactive position.

Figure 4:
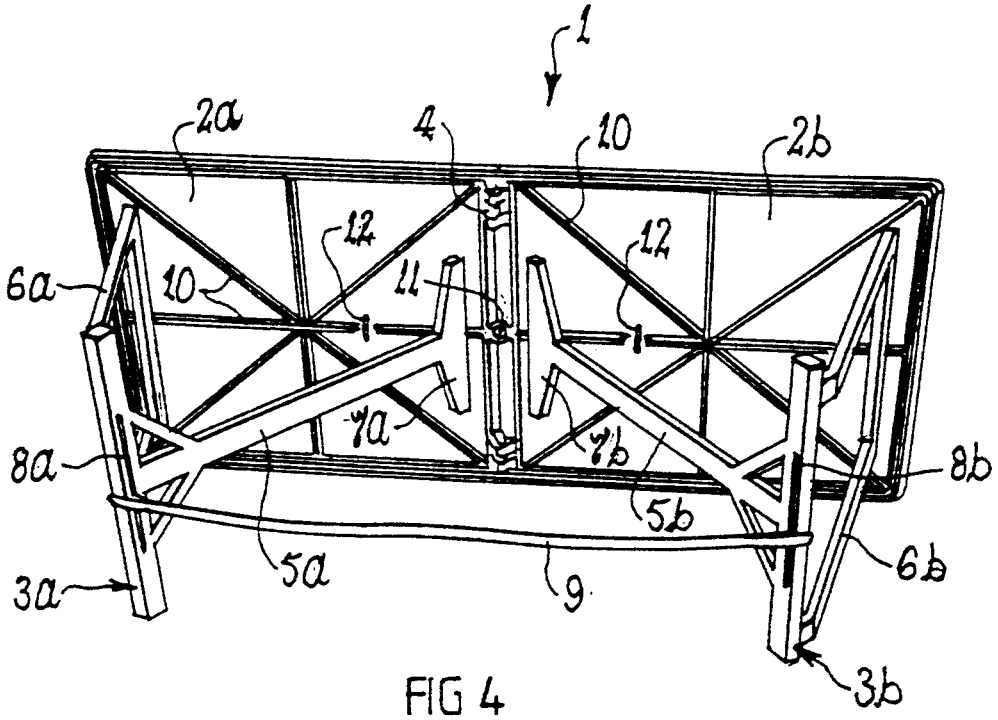
FIG. 4 is an underside view of the table of the present invention it is fully open position.
Figure 5:
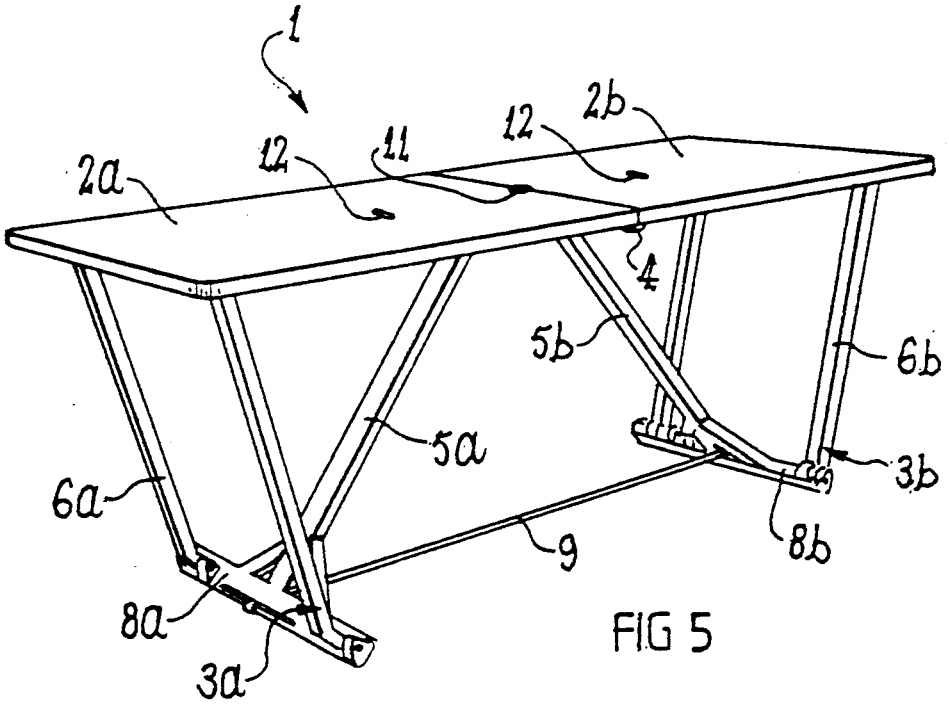
FIG. 5 is a perspective view of the table of the present invention in its fully open state.

The table of the present invention is designated generally throughout the drawings as 1. Table 1 comprises two table-top sections, 2(*a*) and 2(*b*). The table-top sections 2(*a*) and 2(*b*) are hingedly connected by means of hinge 4.

Connected to the underside of table-top sections 2(*a*) and 2(*b*) are leg arrangements 3(*a*) and 3(*b*) respectively. Leg arrangements 3(*a*) and 3(*b*) comprise leg braces 5(*a*) and 5(*b*) respectively and second leg members 6(*a*) and 6(*b*) respectively. The top ends of leg braces 5(*a*) and 5(*b*) are attached to the undersides of their respective table-top sections 2(*a*) and 2(*b*) by means of pivotal connections 7(*a*) and 7(*b*) which are located near hinges 4.

Leg braces 5(*a*) and 5(*b*) are pivotably connected at their bottom ends, 8(*a*) and 8(*b*) to the bottom ends of leg members 6(*a*) and 6(*b*). In the embodiment illustrated, leg members 6(*a*) and 6(*b*) each comprise a pair of parallel struts which function in a manner similar to conventional table legs.

When the leg arrangements are in their operative positions, the top ends of leg members 6 (*a*) and 6(*b*) are held in position against the underside of table-top sections 2(*a*) and 2(*b*) either by means of a simple ledge or by means of resilient clips holding leg members 6(*a*) and 6(*b*) in place.

When the table is disassembled for purposes of storage, the top ends of leg members 6(*a*) and 6(*b*) are moved away from the undersides of table-top sections 2(*a*) and 2(*b*), table-top sections 2(*a*) and 2(*b*)are folded down towards the lower-most parts 8(*a*) and 8(*b*) of leg assemblies 3(*a*) and 3(*b*), so that leg braces 5(*a*) and 5(*b*) become substantially parallel with and adjacent to the undersides of table-top sections 2(*a*) and 2(*b*), and leg members 6(*a*) and 6(*b*) are folded around the outsides of table-top sections 2(*a*) and 2(*b*) until they become substantially parallel to and adjacent the upper sides of table-top sections 2(*a*) and 2(*b*). Indentations or protrusions 12 may be provided in table-top sections 2(*a*) and 2(*b*) in order to allow leg members 6(*a*) and 6(*b*) to clip resiliently into position against the respective table surfaces.

The folding down of the table for the purposes of storage may then be completed by folding to two table-top sections together and tying or clipping them together in the closed position.

A limiting connection in the form of strap 9 is provided to limit the separation between the leg assemblies.

In the preferred embodiment, all of the components of the table are constructed from moulded plastic. Additional strength may be added to the table-top sections by means of reinforcing ribs 10 located on the underside of the table surfaces. An umbrella hole 11 may optionally be provided.

It will be seen that the table of the preferred embodiment is a new type of table which is advantageous in many respects. Because the table folds in the middle, it can be stored in a smaller space than equivalent tables which do not fold. The leg arrangements allow for rapid and convenient setting-up and folding down. The table is strong and will support heavier loads than those supported by most other types of folding tables.

It is to be understood that various modifications, additions and/or alterations may be made to the parts previously described without departing from the ambit of the present invention.

What is claimed is:

1. A folding table comprising:

(a) a table top divided into two sections, each of which has an underside and a topside, the two sections being connected by a hinge arrangement; and (b) on the underside of each table top section a leg arrangement comprising:

(i) a leg brace having a top end and a bottom end, the top end being pivotally attached to the underside of the table top section near the hinge arrangement and (iii) a leg member having a top end and a bottom end, the bottom end of the leg member being pivotally attached to the bottom end of the leg brace and the top end of the leg member being detachably attachable to the underside of the table top section at a location distant from the hinge arrangement wherein when the table is folded, the leg brace of each leg arrangement rests against the underside of the table top section and the leg member rests against the topside of the table top section.

2. A folding table according to claim 1, wherein the table top sections are made from moulded plastic material and have reinforcing ribs on their undersides.

3. A folding table according to claim 1, wherein each leg member comprises a substantially rigid frame.

4. A folding table according to claim 3, wherein each substantially rigid frame comprises two parallel struts having top ends and bottom ends, the struts being connected at their bottom ends and at their top ends by substantially rigid braces.

5. A folding table according to claim 1, further comprising a limiting connection between the two leg arrangements, to limit separation of the leg arrangements.

6. A folding table according to claim 5, wherein the limiting connection is connected at or near the bottom of each leg arrangement.

7. A folding table according to claim 5 wherein the limiting connection is a flexible strap.

* * * * *